US006273006B1

(12) United States Patent
Reutter et al.

(10) Patent No.: US 6,273,006 B1
(45) Date of Patent: Aug. 14, 2001

(54) PALLET ASSEMBLY

(76) Inventors: Robert J. Reutter, 915 N. Hagadorn, Mason, MI (US) 48854; Marc P. Haring, 4284 W. 7 Mile Rd., Roscommon, MI (US) 48653

( * ) Notice: Subject to any disclaimer, the term of this patent is extended or adjusted under 35 U.S.C. 154(b) by 0 days.

(21) Appl. No.: 09/616,025

(22) Filed: Jul. 13, 2000

(51) Int. Cl.[7] ..... B65D 19/44

(52) U.S. Cl. ..... 108/53.1; 211/59.4; 206/510

(58) Field of Search ..... 108/53.1, 53.3, 108/53.5, 55.1, 55.3, 51.11; 206/386, 599, 600, 503, 510; 211/59.4, 85.15, 194, 188

(56) References Cited

U.S. PATENT DOCUMENTS

| | | | | |
|---|---|---|---|---|
| 2,471,693 | | 5/1949 | Lilienfeld | 248/120 |
| 2,498,414 | | 2/1950 | Gondar | 220/8 |
| 2,699,911 | | 1/1955 | Chase et al. | 248/120 |
| 2,828,933 | | 4/1958 | De Pew et al. | 248/120 |
| 2,956,763 | | 10/1960 | D'Arca | 248/120 |
| 3,204,778 | | 9/1965 | Nawman et al. | 211/126 |
| 3,219,196 | | 11/1965 | Hare et al. | 211/126 |
| 3,362,577 | * | 1/1968 | Singer et al. | 206/510 |
| 3,499,398 | | 3/1970 | Murray | 108/53 |
| 3,640,229 | | 2/1972 | Bell | 108/58 |
| 3,648,909 | | 3/1972 | Wisecarver | 224/48 |
| 3,804,033 | | 4/1974 | Izawa et al. | 108/55 |
| 3,850,295 | | 11/1974 | Black | 206/304 |
| 4,000,704 | | 1/1977 | Griffin, Jr. | 108/53 |
| 4,163,495 | | 8/1979 | Drader | 206/506 |
| 4,263,855 | | 4/1981 | Lawlor | 108/53 |
| 4,270,678 | | 6/1981 | Drader | 294/169 |
| 4,413,737 | | 11/1983 | Wind | 206/599 |
| 4,437,412 | | 3/1984 | Trautsch | 108/56.1 |
| 4,480,748 | | 11/1984 | Wind | 206/386 |
| 4,579,489 | * | 4/1986 | Sarantitis | 108/56.3 |
| 5,025,735 | | 6/1991 | Chan et al. | 108/55 |
| 5,088,418 | | 2/1992 | Reckermann et al. | 108/51.1 |
| 5,360,112 | | 11/1994 | Beauchamp | 206/427 |
| 5,429,236 | | 7/1995 | Evans | 206/386 |
| 5,483,899 | | 1/1996 | Christie | 108/56.3 |
| 5,579,700 | | 12/1996 | Nuechterlein et al. | 105/55.1 |
| 5,615,608 | | 4/1997 | Shaw et al. | 108/55 |
| 5,730,295 | | 3/1998 | Darby | 206/600 |
| 5,769,003 | | 6/1998 | Rose et al. | 108/55 |
| 5,799,585 | | 9/1998 | Brennan, Jr. et al. | 108/53 |
| 5,809,904 | | 9/1998 | Darby | 108/55.3 |
| 5,974,981 | | 11/1999 | Ditton | 108/55 |
| 5,983,806 | | 11/1999 | Brennan, Jr. et al. | 108/53 |
| 6,006,675 | | 12/1999 | Heil | 108/55 |

FOREIGN PATENT DOCUMENTS

| | | |
|---|---|---|
| 2674505 | 3/1991 | (FR) . |

* cited by examiner

*Primary Examiner*—Peter M. Cuomo
*Assistant Examiner*—Jerry A. Anderson
(74) *Attorney, Agent, or Firm*—Price, Heneveld, Cooper, DeWitt & Litton

(57) ABSTRACT

A pallet assembly including a main base pallet and at least one small pallet. The main base pallet includes alignment ribs and alignment recesses. The at least one small pallet is configured for removable placement in the alignment recesses of the main base pallet to be maintained in position by the alignment ribs of the main base pallet. The at least one small pallet includes a handle adapted for carrying the at least one small pallet and for laterally supporting objects resting on the at least one small pallet.

27 Claims, 6 Drawing Sheets

PALLET ASSEMBLY

BACKGROUND OF THE INVENTION

The present invention relates to pallets, and in particular to a pallet assembly for transporting ice.

Pallets are used extensively for the transportation and warehousing of industrial and commercial products. The industrial or commercial products are placed on the pallets and can be easily moved with a forklift or other pallet mover in warehouses, factories, vehicles, etc.

Heretofore, pallets have typically been constructed of wood or plastic. Pallets made of wood typically include several cross planks comprising the top surface, several cross planks comprising the bottom surface and several vertically positioned planks between the top surface and the bottom surface. The forks of the forklift or other pallet mover are placed within openings defined by the top surface, bottom surface and the vertical planks to move the wood pallets. However, the planks of the wooden pallets can sometimes crack or break, thus comprising the rigidity of the pallets. Furthermore, when ice is placed on wooden pallets, condensation from the ice can accelerate the decomposition of the wood, thereby shortening the life of the wooden pallet. Pallets made of plastic typically include a one-piece plastic pallet that has a plurality of feet supporting a top surface of the pallet above the ground. The forks of the forklift or other pallet mover are placed under the top surface of the plastic pallet to move the pallet. However, plastic pallets sometimes have less rigidity than wooden pallets and can deflect once lifted by the forks when heavy objects are placed on the plastic pallets. If the plastic pallets deflect to such an extent that a crease is created in the pallet, the plastic pallet can become practically useless for transporting products.

Accordingly, an apparatus is desired solving the aforementioned disadvantages and having the aforementioned advantages.

SUMMARY OF THE INVENTION

One aspect of the present invention is to provide a pallet assembly including a main base pallet and at least one small pallet. The main base pallet includes alignment ribs and alignment recesses. The at least one small pallet is configured for removable placement in the alignment recesses of the main base pallet to be maintained in position by the alignment ribs of the main base pallet. The at least one small pallet includes a handle adapted for carrying the at least one small pallet and for laterally supporting objects resting on the at least one small pallet.

In another aspect of the present invention, a pallet assembly is provided, the pallet assembly including a first base pallet, a second base pallet and a plurality of small pallets. The first and second base pallets have a substantially identical configuration and include alignment ribs and handle recesses. The plurality of small pallets are configured for removable placement on the first base pallet to be located in position by the alignment ribs of the first base pallet. Each of the small pallets includes a handle. The handles of the small pallets are configured for placement in the handle recesses of the second base pallet to maintain the second base pallet above the first base pallet and the small pallets.

Yet another aspect of the present invention is to provide a method of stacking pallets including providing a first base pallet having alignment ribs and handle recesses, locating a plurality of small pallets within the alignment ribs of the first base pallet, providing a second base pallet including alignment ribs and handle recesses with the second base pallet having a substantially identical configuration as the first base pallet, inverting the second base pallet and engaging the second base pallet with the small pallets by inserting the handles of the small pallets into the handle recesses of the second base pallet.

Another aspect of the present invention is to provide a method of transporting ice including providing a main base pallet including alignment ribs and alignment recesses, locating a plurality of small pallets in the alignment recesses of the main base panel; maintaining the plurality of small pallets in position with the alignment ribs of the main base pallet and placing bags of ice on the small pallets.

The principal objects of the present invention include providing a pallet assembly that can easily be used to transport ice and other objects. The pallet assembly includes small pallets that can individually be used to transport ice and other objects. The small pallets can also be placed on a main base pallet in order to transport many small pallets. The small pallets can further include a pivoting handle which allows empty small pallets to be easily transported and stored. Use of the small pallets on the large base pallet provides that the base pallet can be easily moved without deflection of the base pallet. The pallet assembly can be easily and quickly assembled. The pallet assembly also provides simple construction and assembly without tools. The pallet assembly is efficient in use, economical to manufacture, capable of a long operable life, and particularly adapted for the proposed use.

These and other features, advantages and objects of the present invention will be further understood and appreciated by those skilled in the art by reference to the following specification, claims and appended drawings.

DETAILED DESCRIPTION OF THE PREFERRED EMBODIMENT

For purposes of description herein, the terms "upper," "lower," "right," "left," "rear," "front," "vertical,"

Figure 1:
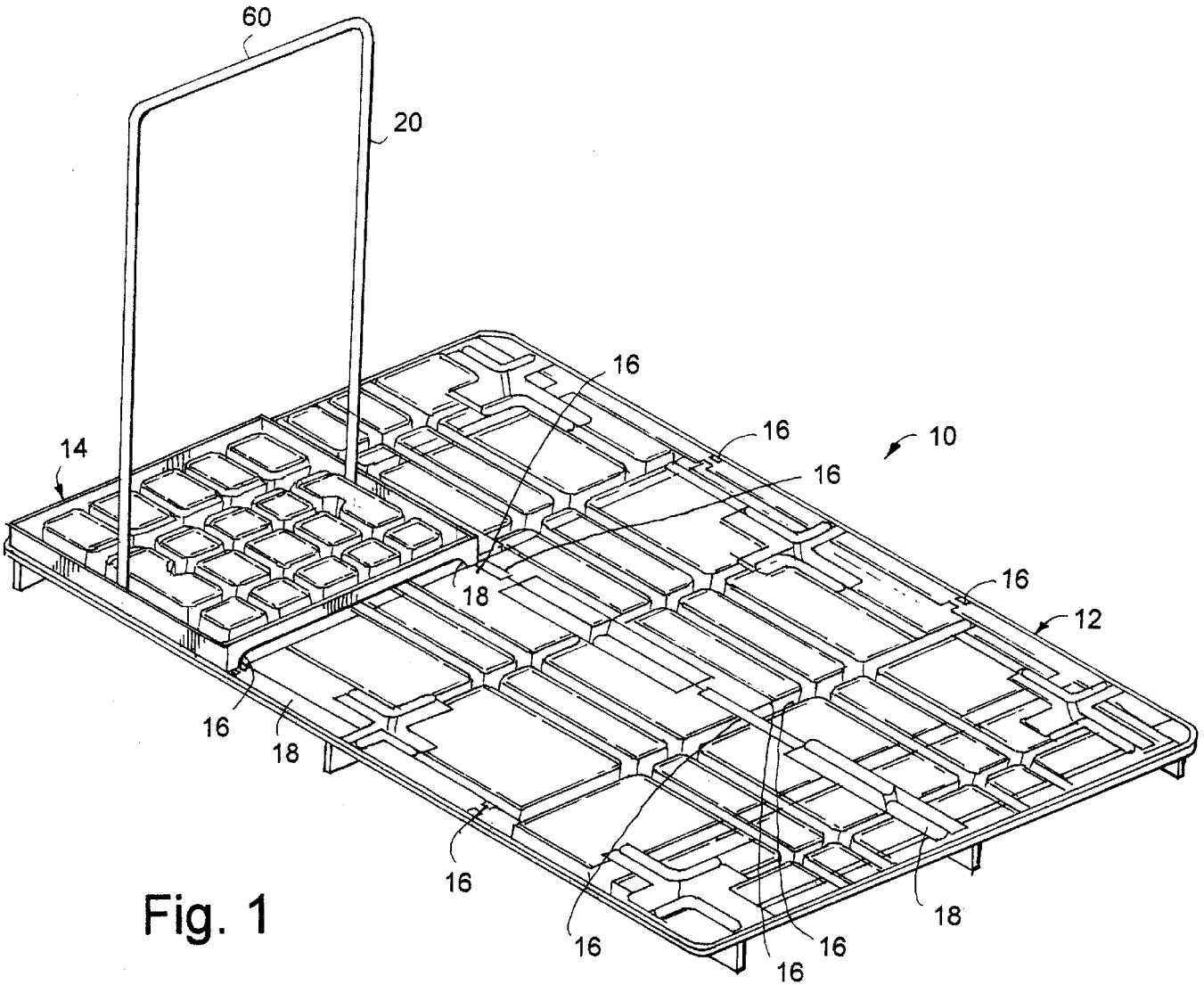
FIG. 1 is a perspective view of the pallet assembly including a main base pallet and a small pallet embodying the present invention.
Figure 2:
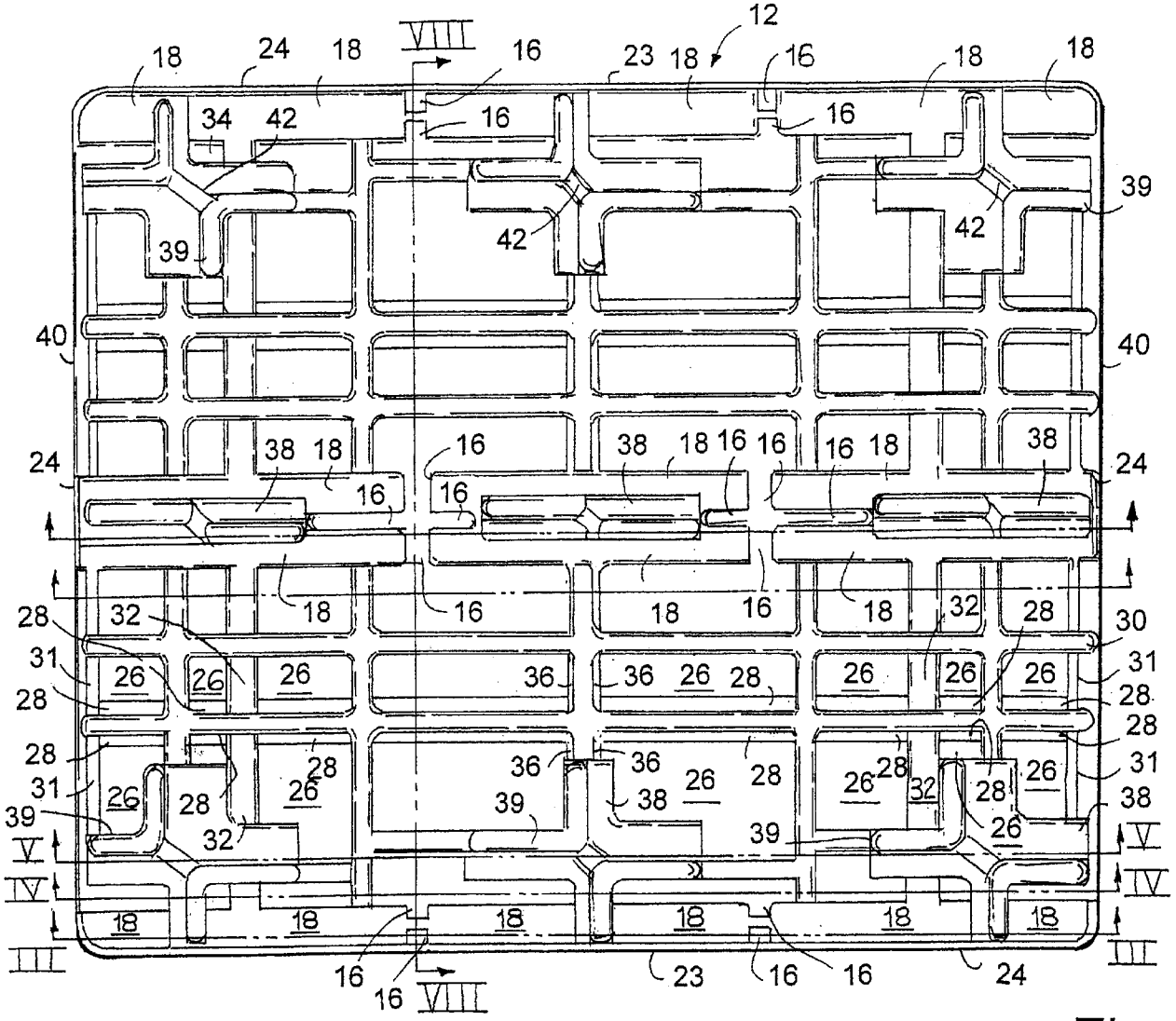
FIG. 2 is a top view of the main base pallet of the present invention.

"horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a pallet assembly embodying the present invention. In the illustrated example, the pallet assembly 10 includes a main base pallet 12 and at least one small pallet 14. The main base pallet 12 includes alignment ribs 16 and alignment recesses 18. The at least one small pallet 14 is configured for removable placement in the alignment recesses 18 of the main base pallet 12 to be maintained in position by the alignment ribs 16 of the main base pallet 12. The at least one small pallet 14 includes a handle 20 adapted for carrying the at least one small pallet 14 and for laterally supporting objects resting on the at least one small pallet 14.

The illustrated main base pallet 12 (FIGS. 2–8) is configured to hold six small pallets 14 such that the small pallets 14 can be moved by and stored on the main base pallet 12. As explained in more detail below, the small pallets 14 include a pair of elongated U-shaped feet 22 configured to be secured in the alignment recesses 18 of the main base pallet 12. The main base pallet 12 is preferably rectangular in order to carry six of the small pallets 14 in a two by three arrangement. The main base pallet 12 also has a configuration such that if the main base pallet 12 was rotated 180°, the main base pallet 12 would have the same appearance. The alignment recesses 18 are arranged with three alignment recesses 18 linearly arranged along each longitudinal side edge 23 of the main base pallet 12 and pairs of alignment recesses 18 located approximately side by side in the middle of the base pallet 12 and parallel to the alignment recesses 18 along the side edges 23. The alignment recesses 18 of the main base pallet 12 are arranged in pairs to accept the small pallets 14, wherein each pair of alignment recesses 18 includes one of the alignment recesses 18 along the side edge 23 of the main base pallet 12 and the closest alignment recess 18 that is located approximately in the middle of the main base pallet 12 parallel to the alignment recesses 18 on the side edge 23. Two of the alignment ribs 16 are located along a lateral mid line of the main base pallet 12 and a pair of the alignment ribs 16 are located between each of the alignment recesses 18 along the side edges 23 of the main base pallet 12. The alignment ribs 16 located along the lateral mid line of the main base 12 have a substantially cross-shaped configuration and the pairs of alignment ribs 16 along the side edges 23 of the main base pallet 12 each have a substantially rectangular cross-section. The alignment ribs 16 are therefore located between the alignment recesses 18 in order to maintain the small pallets 14 in position.

Figure 3:
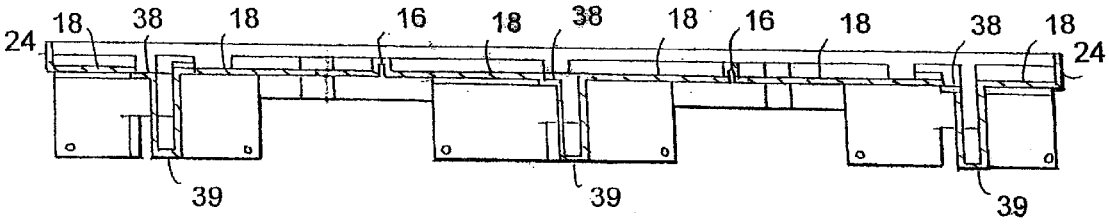
FIG. 3 is a cross-section view of the main base pallet of the present invention taken along the III—III, FIG. 2.
Figure 4:
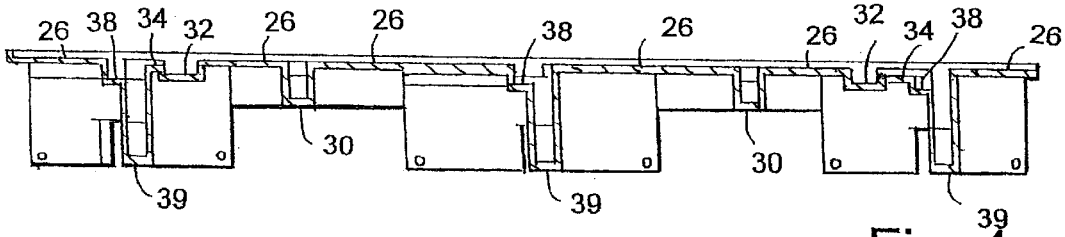
FIG. 4 is a cross-section view of the main base pallet of the present invention taken along the line IV—IV, FIG. 2.
Figure 5:
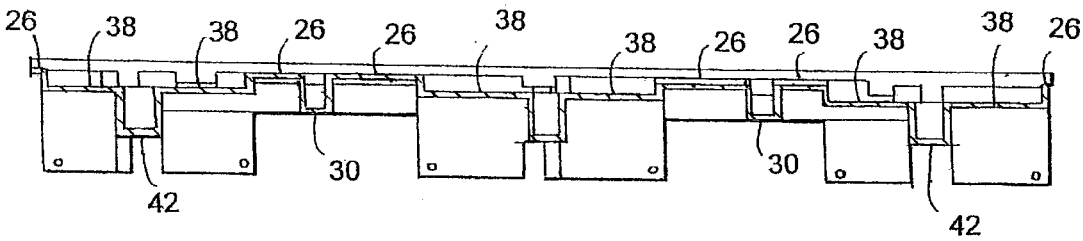
FIG. 5 is a cross-section view of the main base pallet of the present invention taken along the line V—V, FIG. 2.
Figure 6:
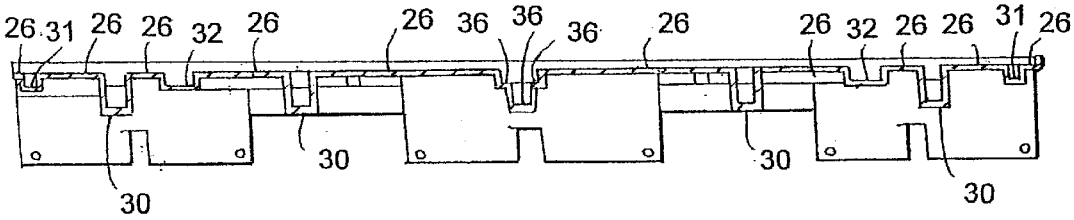
FIG. 6 a cross-section view of the main base pallet of the present invention taken along the line VI—VI, FIG. 2.
Figure 7:
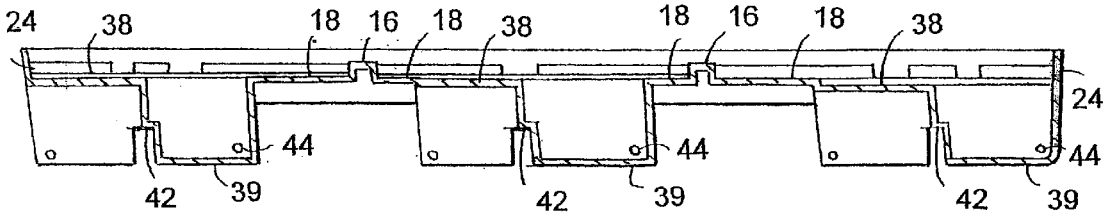
FIG. 7 is a cross-section view of the main base pallet of the present invention taken along the line VII—VII, FIG. 2.
Figure 8:
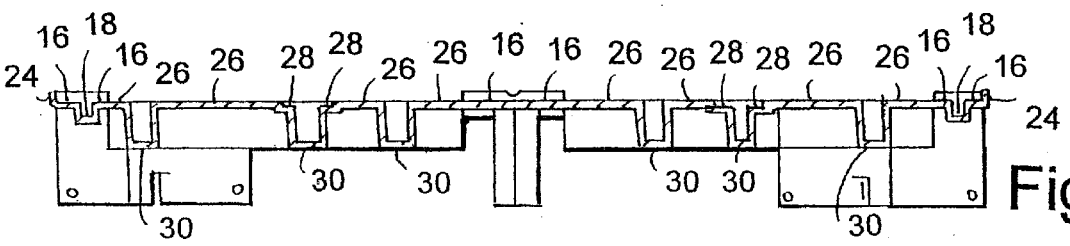
FIG. 8 is a cross-section view of the main base pallet of the present invention taken along the line VIII—VIII, FIG. 2.
Figure 11:
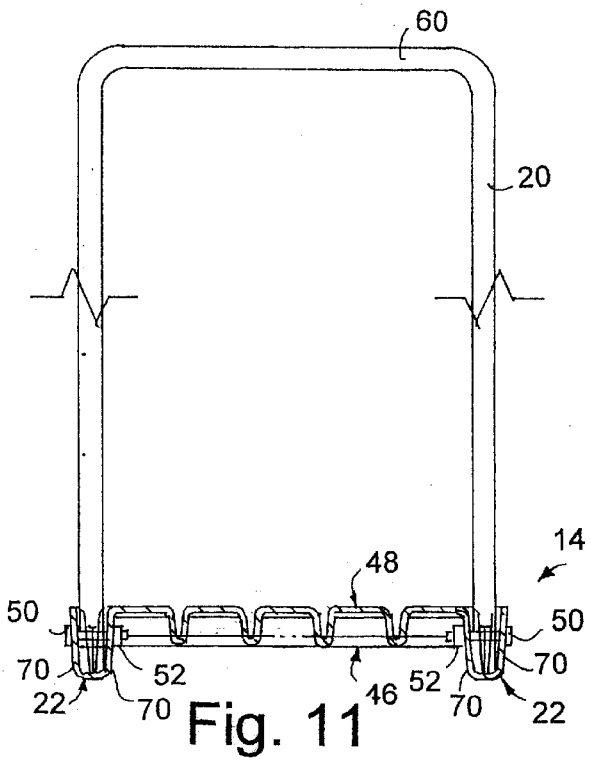
FIG. 11 is a cross-section view of the small pallet of the present invention taken along the line XI—XI, FIG. 9.

In the illustrated example, the main base pallet 12 also includes upstanding side edges 24, small pallet platforms 26, drain ledges 28, drain channels 30, drain canals 31 and feet 39 at varying heights. The upstanding side edges 24 are located along the longitudinal side edges 23 of the main base pallet 12 and assist the pairs of alignment ribs 16 along the side edges 23 of the main base pallet 12 in maintaining the small pallets 14 in position. The upstanding side edges 24 also wrap a short distance along the lateral side edges 40 adjacent the alignment recesses 18 bordering both the longitudinal side edges 23 and the lateral side edges 40. Upstanding side edges 24 are also located along the middle of the lateral side edges 40 bordering the alignment recesses 18 adjacent the middle of the main base pallet 12. As seen in FIGS. 3 and 8, the upstanding side edges 24 have the tallest height of any portion of the main base pallet 12. The small pallet platforms 26 are polygonal and are located about the main base pallet 12 for abutting a bottom surface 46 of the small pallets 14 (see FIG. 11). The small pallet platforms 26 are preferably located at a height equal to a height of the alignment ribs 16. The polygonal shapes of the small pallet platforms 26 are substantially defined by the drain channels 30. The drain channels 30 drain liquids on the main base pallet 12 to the feet 39. The drain channels 30 are configured in a crossing pattern with four parallel drain channels 30 along the longitudinal direction of the main base pallet 12 and five drain channels 30 along the lateral direction perpendicularly crossing the drain channels 30 along the longitudinal direction. Auxiliary drain channels 30 are also located off of the drain channels 30 along the lateral direction and directly connect the drain channels 30 to the feet 39. The drain channels 30 are located at a height below the alignment tabs 16, alignment recesses 18 and the small pallet platforms 26. Drain canals 31 are located adjacent each lateral side edge 40 of the main base pallet 12. The drain canals 31 work with the drain channels 30 to drain liquids off of the main base pallet 12. The feet 39 support the main base pallet 12 above the ground. Feet 39 along the outside of the main base pallet 12 are substantially L-shaped and include two substantially perpendicular portions. The feet along the outside of the main base pallet are connected in pairs by a support strut 42, with the support strut 42 being located between the meeting point of the two substantially perpendicular portions of the L-shaped feet 39. Each pair of L-shaped feet 39 are arranged such that one portion of one of the pair of feet 39 is parallel with one portion of the other of the pair of feet 39. Feet 39 adjacent the lateral mid-line of the main base pallet 12 are linear and are connected in pairs by the support struts 42. The pairs of feet 39 adjacent the mid-line of the main base pallet 12 are parallel. As seen in FIG. 5, the support struts 42 are approximately half the height of the feet 39. The feet 39 preferably include drain holes 44 to provide an outlet for the liquids drained into the feet from the drain channels 30 and the drain canals 31. As explained in more detail below, the feet 39 and the support struts 42 are used to stack main base pallets 12 and small pallets 14.

Figure 9:
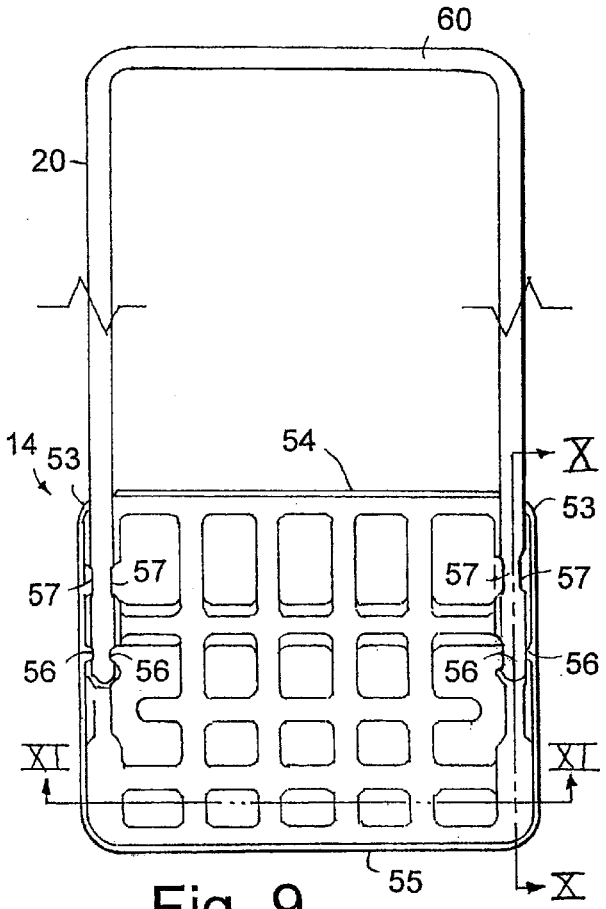
FIG. 9 is a top view of the small pallet of the present invention.
Figure 10:
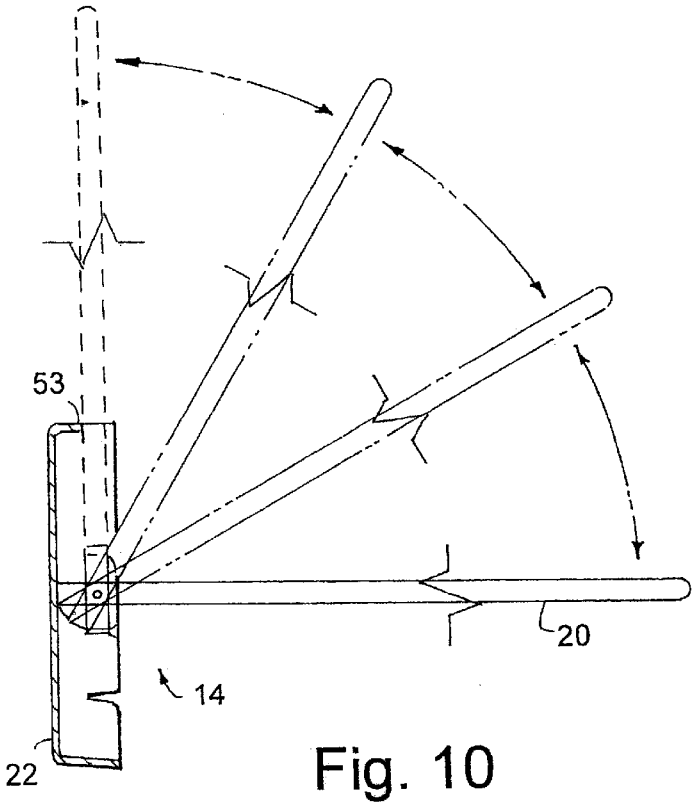
FIG. 10 is a cross-section view of the small pallet of the present invention taken along the line X—X, FIG. 9.

In the illustrated example, the small pallet 14 (FIGS. 9–11) has a substantially rectangular configuration and includes a bottom surface 46 having a substantially waffle-like configuration, the pair of elongated U-shaped feet 22 and the handle 20. The small pallet 14 also has a top surface 48, which is the converse of the bottom surface 46. During use, objects are placed onto the top surface 48 of the small pallet 14 and are laterally supported by the handle 20. As seen in FIG. 9, the U-shaped feet 22 are positioned along the side edges of the small pallet 14 and the handle 20 is pivotally connected to the U-shaped feet 22 at approximately the middle of the length of the U-shaped feet 22 by a bolt 50 extending through the walls 70 of the U-shaped feet 22. A nut 52 secures the bolt 50 to the small pallet 14. The small pallet 14 also has a front side wall 55 and a back side wall 54, the front side wall 55 being integral with the outside walls 70 of the U-shaped feet 22. As seen in FIG. 9, the handle 20 rests within a portion of the recess of the U-shaped feet 22 between the walls 70 when the handle 20 is in a down position. A space 53 is located between the back side walls 54 and the outside walls 70 of the U-shaped feet 39 so that the handle 20 can be positioned parallel with the U-shaped feet 39. The handle 20 is pivotable between an upright position (FIG. 11) and the down position (FIG. 9). The handle 20 is placed in the upright position in order to carry the small pallet 12 and, as explained in more detail below, in order to stack more base pallets 12 and small pallets 14 above the main base pallet 12 on the ground. Furthermore, the handle is placed in the down position for easily transporting unused small pallets 14 because the small pallets 14 will therefore be substantially planar. A first pair of tabs 57 protruding from the outside wall of the U-shaped feet 22 and the top surface 48 snap-lock over the handle 20 in order to maintain the handle in the down position. Furthermore, as the handle 20 is rotated to the upright position, the handle 20 will snap over the first pair of tabs 57 and a second pair of tabs 56 protruding from the outside walls of the U-shaped feet 22 and the top surface 48. The second pair of tabs 56 snap-lock over the handle 20 as the handle 20 is being moved to the upright position in the middle of the small pallet 14 in order to maintain the handle 20 in the upright position.

Figure 12:
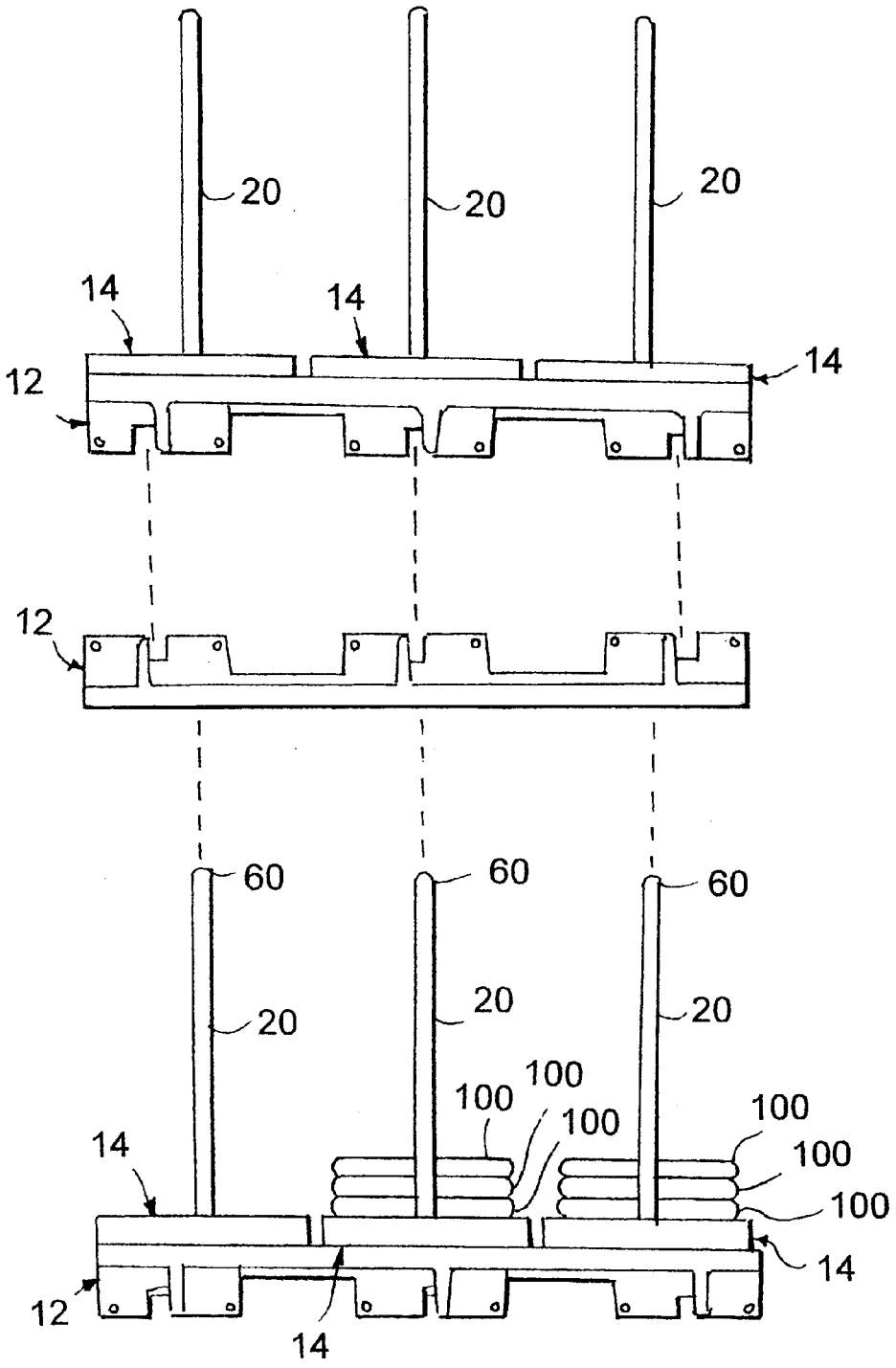
FIG. 12 is a side view of three base pallets vertically stacked to transport twelve small pallets of the present invention.

As seen in FIG. 12, two base pallets 12 can be stacked vertically in order to support twelve small pallets 14. In order to stack two base pallets 12, six small pallets 14 are first placed on the lower base pallet 12 by placing the small pallets 14 within the alignment ribs 16 of the lower base pallet 12. An upper base pallet 12 having a substantially identical configuration as the lower base pallet 12 is inverted and placed on the handles 20 of the six small pallets 14. As seen in FIGS. 2–8, the main base pallet 12 includes handle recesses 32, handle tabs 34 and handle ledges 36. The handle recesses 32 are parallel with the lateral side edges 40 of the main base pallet 12 and are located approximately ⅙ of the length of the main base pallet from the lateral side edges 40. The handle recesses 32 of the upper base pallet 12 that is inverted are therefore located even with the top cross bars 60 of the handles 20 of the small pallets 14 along the lateral side edges 40 of the lower main base pallet 12. Furthermore, handle ledges 36 are located on either side of the drain channel 30 along the longitudinal mid-line of the main base pallet 12. The handle ledges 36 receive the handles 20 of the small pallets 14 along the longitudinal mid-line of the main base pallet 12. Therefore, the upper main base pallet 12 is engaged with the small pallets 14 by engaging handles 20 of the small pallets 14 with the handle recesses 32 and the handle ledges 36 of the inverted upper base pallet 14. The main base pallets 12 also include four rectangular handle tabs 34 located adjacent the ends of the handle recesses 32 for maintaining the handles 20 in position. It is contemplated, however, that the areas of the main pallet 12 which comprise the handle tabs 34 could be lowered and have a same height as the adjoining areas. Preferably, the handle recesses 32 and the handle ledges 36 are the same height as the alignment recesses 18. The handle tabs 34, however, are preferably higher than the handle recesses 32 and the handle ledges 36, but lower than the small pallet platforms 26.

As seen in FIG. 12, a top main base pallet 12 in an upright position is placed on the inverted upper main base pallet 12 so that another six small pallets 14 can be supported along with the six small pallets 14 supported on the lower main base pallet 12. As seen in FIGS. 2–8, the base pallets 12 include feet supports 38 located adjacent the feet 39. The feet supports 38 are located at a height below the alignment recesses 18, where the bottoms of the feet 39 of the top upright base pallet 12 rest upon and abut the feet supports 38 of the inverted upper base pallet 12. Likewise, the bottoms of the feet 39 of the inverted upper base pallet 12 abut the feet supports 38 of the top upright base pallet 12. Furthermore, the support struts 42 of the feet 39 along the outside of the main base panel 12 are juxtaposed in a cross like manner such that each portion of one of the L-shaped feet 39 on the inverted upper main base pallet 12 is parallel to and abuts a portion of one of the L-shaped feet 39 on the top upright base pallet 12. Likewise, each portion of one of the L-shaped feet 39 on the top upright main base pallet 12 is parallel to and abuts a portion of one of the L-shaped feet 39 on the inverted upper base pallet 12. Moreover, the support struts 42 of the feet 39 along the longitudinal middle of the base pallet 12 are juxtaposed in a cross like manner such that each foot 39 along the middle of the inverted upper main base pallet 12 is parallel to and abuts a foot along the middle of the top upright base pallet 12. Likewise, each foot 39 along the middle of the top upright main base pallet 12 is parallel to and abuts a foot along the middle of the inverted upper base pallet 12. Therefore, opposite feet 39 on the upper inverted base pallet 12 and the top upright base pallet lock the upper inverted base pallet 12 and the top upright base pallet 12 in position relative to each other. It is contemplated that three or more levels of small pallets 12 can be stacked on one main base pallet 12.

The pallets 12 and 14 are preferably used to store and transport ice by placing bags of ice 100 on the small pallets 12 after the small pallets 12 are placed in the alignment recesses 18 of the main base panel 12. Preferably, the stacked base pallets 12 are only used for storing bags of ice 100 and only a single base pallet 12 is used for transporting the bags of ice 100. It is contemplated, however, that stacked base pallets 12 could be used to transport bags of ice 100. Furthermore, the stacked base pallets 12 could be used to transport items other than bags of ice 100. When the bags of ice 100 are placed on the small pallets 14, the bags of ice 100 are preferably laterally supported by the handles 20 of the small pallets 14, thereby preventing the bags of ice 100 from sliding off of the top surface 48 of the small pallets 14.

Preferably, the main base pallet 12 and the small pallets 14 are made of HDPE having a thickness of approximately 2.5"–3.5" in a mold. The handle 20 of the small pallet 14 is preferably made from steel, although it is contemplated that the handle 20 could be made of plastic. However, the pallets could be made of any material and in any process typically used to form plastic parts. It is contemplated that the pallets could have steel, aluminum or other metal strips within the plastic to further support the pallets.

The above description is considered that of the preferred embodiment only. Modification of the invention will occur to those skilled in the art and to those who make or use the invention. For example, it is contemplated that any number of small pallets 14 could be placed on each main base pallet 12. Therefore, it is understood that the embodiment shown in the drawings and described above is merely for illustrative purposes and not intended to limit the scope of the invention, which is defined by the following claims as interpreted according to the principles of patent law, including the doctrine of equivalents.

The invention claimed is:

1. A pallet assembly comprising:

a main base pallet including alignment ribs and alignment recesses;

at least one small pallet configured for removable placement in the alignment recesses of the main base pallet to be maintained in position by the alignment ribs of the main base pallet;

wherein the at least one small pallet includes a handle adapted for carrying the at least one small pallet and for laterally supporting objects resting on the at least one small pallet.

2. The pallet assembly as set forth in claim 1, further including:

bags of ice resting on the at least one small pallet.

3. The pallet assembly as set forth in claim 2, wherein:

the bags of ice are held in position on the at least one small pallet by the handle.

4. The pallet assembly as set forth in claim 1, wherein:

the handle is pivotable between an upright position and a down position, the at least one small pallet configured to snap lock the handle in the upright position.

5. The pallet assembly as set forth in claim 1, wherein:

the at least one small pallet includes a bottom surface having a substantially waffle-like configuration, and a pair of elongated U-shaped feet.

6. The pallet assembly as set forth in claim 5, wherein:

the main base pallet includes small pallet platforms for abutting the bottom surface of the small pallets, the small pallet platforms being located at a height equal to a height of the alignment ribs.

7. The pallet assembly as set forth in claim 6, wherein:

the alignment recesses are located at a height lower than the height of the alignment ribs and the height of the small pallet platforms.

8. The pallet assembly as set forth in claim 7, wherein:

the main base pallet includes a plurality of pairs of L-shaped feet, each pair of L-shaped feet being connected by a support strut, the support struts being approximately half the height of the feet.

9. The pallet assembly as set forth in claim 8, wherein:

the main base pallet includes drain channels located at a height below the small pallet platforms for draining liquids on the main base pallet to the feet.

10. The pallet assembly as set forth in claim 9, wherein:

the feet of the main base pallet includes drain holes to provide an outlet for liquids in the feet.

11. The pallet assembly as set forth in claim 1, wherein:

the at least one small pallet includes six small pallets.

12. A pallet assembly comprising:

first and second base pallets, each of the first and second base pallets having a substantially identical configuration and including alignment ribs and handle recesses;

a plurality of small pallets configured for removable placement on the first base pallet to be located in position by the alignment ribs of the first base pallet, each of the small pallets including a handle;

wherein the handles of the small pallets are configured for placement in the handle recesses of the second base pallet to maintain the second base pallet above the first base pallet and the small pallets.

13. The pallet assembly as set forth in claim 12, further including:

bags of ice resting on the small pallets.

14. The pallet assembly as set forth in claim 13, wherein:

the bags of ice are held in position on the small pallets by the handles.

15. The pallet assembly as set forth in claim 12, wherein:

the handles are pivotally attached to the small pallets.

16. The pallet assembly as set forth in claim 12, further including:

a third base pallet configured to be located above the second base pallet and engaged with the second base pallet, the third base pallet having a substantially identical configuration as the first and second base pallets.

17. The pallet assembly as set forth in claim 16, wherein:

each of the first, second and third base pallets include a plurality of pairs of L-shaped feet, each pair of L-shaped feet being connected by a support strut, the supports struts being approximately half the height of the feet, whereby the third base pallet is engaged with the second base pallet by overlapping the support struts on the third base pallet with the support struts on the second base pallet.

18. The pallet assembly as set forth in claim 17, further including:

a plurality of small pallets for removable placement on the third base pallet to be located in position by the alignment ribs of the third base pallet, each of the small pallets for removable placement on the third base pallet including a handle.

19. The pallet assembly as set forth in claim 12, wherein:

the small pallets include a bottom surface having a substantially waffle-like configuration, and a pair of elongated U-shaped feet.

20. The pallet assembly as set forth in claim 19, wherein:

the first and second base pallets include small pallet platforms for abutting the bottom surface of the small pallets, the small pallet platforms being located at a height equal to a height of the alignment ribs.

21. The pallet assembly as set forth in claim 20, wherein:

the first and second base pallets include alignment recesses for engaging the elongated U-shaped feet of the small pallets, the alignment recesses being located at a height lower than the height of the alignment ribs and the height of the small pallet platforms.

22. The pallet assembly as set forth in claim 21, wherein:

the first and second base pallets include drain channels located at a height below the small pallet platforms for draining liquids on the first and second base pallets to the feet.

23. The pallet assembly as set forth in claim 22, wherein:

the feet of the first and second base pallets include drain holes for allowing liquids on a top surface of the first and second base pallets to escape.

24. The pallet assembly as set forth in claim 12, wherein:

the plurality of small pallets includes six small pallets.

25. A method of stacking pallets comprising:

providing a first base pallet including alignment ribs and handle recesses;

locating a plurality of small pallets within the alignment ribs of the first base pallet, providing a second base pallet including alignment ribs and handle recesses, the second base pallet having a substantially identical configuration as the first base pallet;

inverting the second base pallet; and engaging the second base pallet with the small pallets by inserting the handles of the small pallets into the handle recesses of the second base pallet.

26. The method of stacking pallets as set forth in claim 25, wherein:

the handles are pivotally attached to the small pallets.

27. The method of stacking pallets as set forth in claim 25, further including:

placing bags of ice on the small pallets.

* * * * *